United States Patent [19]

Wittmann et al.

[11] 4,428,597

[45] Jan. 31, 1984

[54] HEEL HOLDER FOR A SAFETY SKI BINDING

[75] Inventors: Heinz Wittmann; Vladimir Konwitza, both of Vienna, Austria

[73] Assignee: TMC Corporation, Baar, Switzerland

[21] Appl. No.: 318,243

[22] Filed: Nov. 4, 1981

[30] Foreign Application Priority Data

Nov. 7, 1980 [AT] Austria ..... 5473/80

[51] Int. Cl.[3] ..... A63C 9/08

[52] U.S. Cl. ..... 280/626; 280/633

[58] Field of Search ..... 280/631, 632, 633, 634, 280/626, 614, 618, 620

[56] References Cited

U.S. PATENT DOCUMENTS

| | | | |
|---|---|---|---|
| 3,278,195 | 10/1966 | Salomon | 280/626 |
| 3,575,438 | 4/1971 | Unger | 280/626 |
| 3,776,567 | 12/1973 | Shimizu et al. | 280/631 |
| 4,066,277 | 1/1978 | Murata | 280/626 |
| 4,088,342 | 5/1978 | Hausleithner | 280/633 X |
| 4,088,344 | 5/1978 | Hausleithner | 280/626 |
| 4,307,895 | 12/1981 | Storandt et al. | 280/632 |

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

The invention relates to a heel holder for a safety ski binding, in particular for a safety ski binding for use in both cross-country skiing and downhill skiing. The heel holder has a bearing block fixedly oriented relative to the ski and a housing which carries a sole holder. The housing is supported for an upward pivoting movement about a transversely extending axis provided on the bearing block and against the force of a spring. A spring is arranged in a chamber provided on the housing. One end of the spring is supported on a housing-fixed part and the other end is supported on an adjustable abutment pivotally supported on the bearing block. A two-arm release lever is hingedly connected to the bearing block for effecting a switching between a cross-country mode and a downhill mode of skiing as well as a release of the ski boot from the binding. A control bolt exists on the housing and is guided along a control cam surface arranged on the two upstanding sidewalls of the bearing block.

9 Claims, 10 Drawing Figures

HEEL HOLDER FOR A SAFETY SKI BINDING

FIELD OF THE INVENTION

This invention relates to a heel binding structure convertible between a cross-country and a downhill mode of skiing and having structure for facilitating a release of the ski boot from the binding.

BACKGROUND OF THE INVENTION

A heel holder of the above-mentioned type is for example described in U.S. Pat. No. 3,776,567. In this known design the upper end of the abutment which closes off the spring chamber is threadedly engaged with a rod coaxially extending through the center of the spring, the lower end of which rod extends through the bottom of the spring chamber and is swingably supported on a pin fixed to the bearing block. Control cam surfaces are provided which are arranged on the edges of the two sidewalls of the bearing block facing the sole down-holding means. Each control cam surface has a region which extends vertically with respect to the upper side of the ski and a curved region, the center of curvature of which lies on the axis of the aforesaid pin. The sole down-holding means is adjustable on the housing in elevational direction and is therefore designed as a separate structural part. The spring chamber and thus also the spring are arranged vertically in the downhill skiing position of the heel holder. However, the spring force acts through the sole down-holding means onto the heel of a ski shoe inserted into the binding to press only in the vertical direction onto the ski shoe, thus toward the upper side of the ski. Thus, it is necessary to hold and prevent the heel of the ski shoe from moving laterally which is done by means of a further structural part which has two lateral sole holders and is also swingably supported. The desired effect mentioned in this reference is that no force whatsoever is to be applied from the heel holder onto the front jaw. However, this in practice results in undesired disadvantages. For example, this binding is not capable of compensating for a bending of the ski, as it occurs for example during skiing on slopes with many moguls and results in a deformation of an inserted ski shoe or also in an insufficient holding of the inserted ski shoe in the binding. Furthermore, it is disadvantageous in this heel holder that the control cam surfaces which are provided for determining a release operation are exposed thereby raising the risk that both dirt and ice will accumulate therein. Since the control bolt, functional during a release operation, is not forceably guided on the control cam surfaces, it can lift off from the control cam surfaces so that their function as "control cam surfaces" is jeopardized.

A further heel holder is described in Austrian Pat. No. 357 076 and in the corresponding U.S. Pat. No. 4,088,344. In this heel holder, a rotatably supported disk is held on each of the sidewalls of the bearing block. In each disk there is provided a control cam surface which is angled at an obtuse angle. The range of rotation of the disks is limited by stops. A control bolt is guided on the control cam surfaces, which control bolt is fixedly connected to a swingable housing. A spring is arranged in a spring chamber provided on the housing. One end of the spring is supported on a pin which extends through the spring chamber and which is anchored on the sidewalls of the bearing block. The initial tension of the spring cannot be changed. In order to adjust for different release forces, each cam is adjustable on both sides by means of a screw on a release lever hingedly secured to the bearing block. The cams determine the position of stops on the disks and thus the respective setting angle of the control cam surfaces, whereby a large setting angle causes a high release force. An important disadvantage of this conventional heel holder consists in it having many structural parts and an expensive release mechanism. Due to the many structural parts which are frictionally coupled, uncontrollable frictional forces develop. Thus it has been proven in practice that during successive releases very different and seldom reproducible release values occur, which raises the risk of injury to a skier using the binding.

Therefore, the purpose of the invention is to provide a heel holder of the above-mentioned type which does not have the disadvantage of conventional types of construction, which is easily constructed and assures also in extreme situations constant release values.

This set purpose is inventively attained by each control cam surface being constructed on the inside of the sidewall of the bearing block, by the pivot axis of the housing being arranged on the upper area of the bearing block, and by the pivot axis being offset rearwardly relative to the control bolt.

Thus the control cam surfaces are protected against outside influences. By positioning the pivot axis relative to the two control cam surfaces, the bolt which is held on the housing is pressed against the control cam surfaces to assure, on the one hand, a secure holding of a ski shoe inserted into the binding and, on the other hand, a proper and repeatable release function determined by the control cam surfaces in all situations.

An important concept of the invention consists in each control cam surface being formed by the edges of an arcuately shaped recess in each of the sidewalls of the bearing block, wherein each control cam surface has a first curved section, the tangent to which defines a starting portion which is oriented at an acute angle $\alpha$ greater than 12°, preferably at approximately 75°, to the longitudinal axis of the ski, viewed from the side of the ski, and the tangent to the end portion of the curved section defines with the longitudinal axis of the ski an angle $\beta$, which is greater than 90°, preferably approximately 140°, whereby the length of the curved section determines the elasticity range of the heel holder. The release characteristic is precisely determined through these measures. The form of the curved section determines the course of the force over the covered distance in a force-distance-diagram.

During the further course each control cam surface is designed inventively so that the first curved section is followed by a further curved section, to assure a slight relaxing of the spring, wherein the relaxation distance of the spring is determined by the difference between two distances, wherein S is the distance of a point on the curved section from the pivot axis of the housing farthest from the pivot axis and s is the distance of a termination point on the first curved section from the pivot axis. The spring is compressed by the amount of this difference during a stepping into the binding. Thus the stepping-in force can be precisely determined or fixed.

A further concept of the invention consists in the adjustable abutment of the spring being held in a sleeve which is open on one side, which sleeve is held by pins forming the pivot axis of the housing on the bearing block. The sleeve has two shoulders received in guide grooves which are oriented parallel with respect to the longitudinal extent of the sleeve on the housing. These measures assure a movability of the housing relative to the sleeve without using additional structural parts.

The invention relates furthermore to a heel holder for a safety ski binding having a cross-country plate which carries the bearing block thereon and which can be swung upwardly about an axis which extends transversely with respect to the longitudinal axis of the ski, wherein the housing carries at least one cam engageable by a bolt arranged on the release lever and which extends transversely with respect to the longitudinal axis of the ski. The bolt also effects an operation of a locking element for locking or unlocking of the cross-country plate on the ski. The housing can by means of the release lever be swung with the sole down-holding means in the simplest manner into the open position. It is particularly preferable that the release lever can simultaneously operate a locking mechanism which is arranged below the heel holder.

A further preferable development of the invention relates to the provision of a release lever having a slide member thereon. The slide member has a locking lever to cause the movement of locking noses on the slide member to move into and out of locking recesses provided on the sidewalls of the bearing block and against the force of a spring. Separate locking recesses are provided for fixing the release lever in its cross-country skiing position and in its downhill skiing position. Thus a secure fixing of the release lever both in the downhill skiing position and also in the cross-country skiing position is assured. The slide member is operated manually in the simplest manner.

The spring on the slide member is according to a further characteristic of the invention compactly housed and without interference by placing same in a cavity on the release lever provided between the locking lever and the slide member. The spring is supported at its one end on the slide member and at its other end on a web portion on the release lever.

A further important inventive characteristic consists in the provision of a control guideway being provided on the bearing block and extending in a direction toward the tail of the ski, which guideway merges into the locking recesses, whereby, viewed in a side view, the distance of successive points on the control guideway from the axis of the release lever increases continuously, which control guideways are movable along the slide member during a swinging of the release lever in a clockwise direction against the force of the spring on the release lever. During a swinging of the release lever in the clockwise direction for effecting an arbitrary opening of the heel holder, the spring is compressed in the slide member and effects an automatic return of the release lever into its initial position as soon as the binding opens. This measure contributes to the comfortable operation of the heel holder and prevents the risk of injury, which could occur when the binding is closed and the release lever springs backwardly.

BRIEF DESCRIPTION OF THE DRAWINGS

The invention will now be described in greater detail with reference to the drawings, in which:

FIG. 7 is a perspective view of the locking element;

FIG. 8 is a cross-sectional top view of the locking element in its position for cross-country skiing and FIG. 9 is a cross-sectional top view of the locking element in its position for downhill skiing.

DETAILED DESCRIPTION

Figure 1:
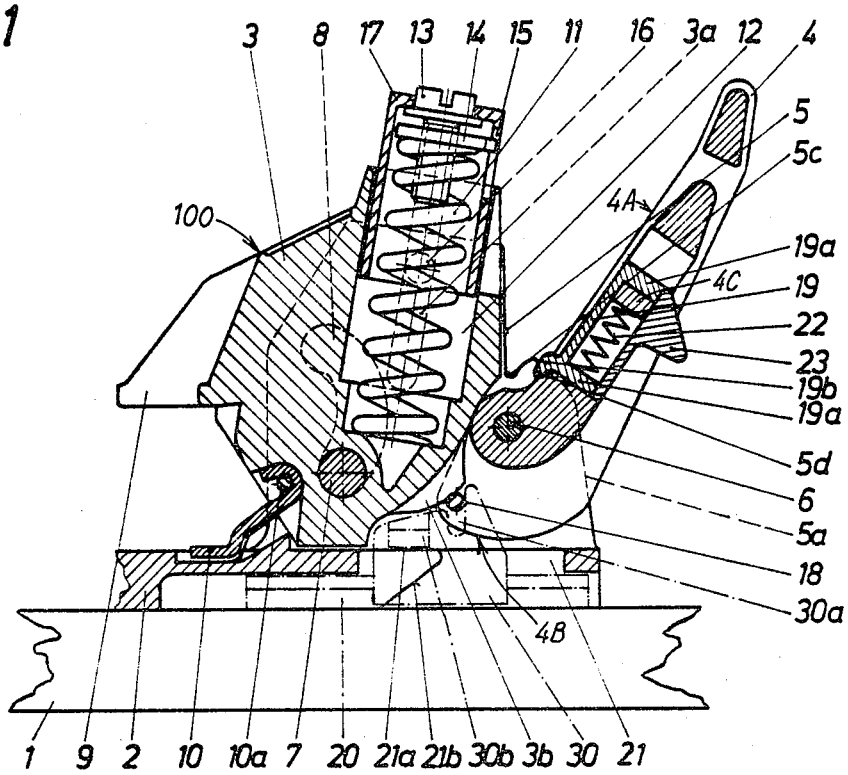
FIG. 1 is a cross-sectional side view of the inventive heel holder in a downhill skiing position.

The heel binding or holder 100 of a safety ski binding arrangement utilizable for both downhill skiing and cross-country skiing is arranged as illustrated in FIG. 1 on a ski 1. The safety ski binding arrangement includes a front jaw (not illustrated) and a cross-country plate 2 which is hingedly connected to the front jaw. Such an arrangement is shown for example in the U.S. Pat. No. 4,088,342. The cross-country plate has mounted thereon adjacent its rear end the aforesaid heel holder 100. The heel holder or the cross-country plate 2 can be fixedly connected to the ski 1 by means of a locking mechanism, the design of which will be discussed in greater detail below.

A bearing block 5 is integrally arranged on the cross-country plate 2 and consists substantially of two upstanding and laterally spaced sidewalls, between which a housing 3 of the heel holder 100 is arranged. The housing 3 has a sole down-holding means 9 thereon connected in a conventional manner, and a pin 10*a* pivotally supporting a stepping spur 10 for a limited swinging movement. An elongated and cylindrical control bolt 7 is arranged perpendicularly with respect to the longitudinal axis of the cross-county plate 2 and extends through the housing 3, the opposite axial ends of the bolt 7 are received in elongated and arcuately shaped openings 8 in the inner side of each of the spaced sidewalls of the bearing block 5 and are thereby guided on the inner edges of the openings 8. The inner edges each define a control cam surface 8*a*. This special construction of the control cam surface 8*a* will be described in greater detail below.

Figure 4:
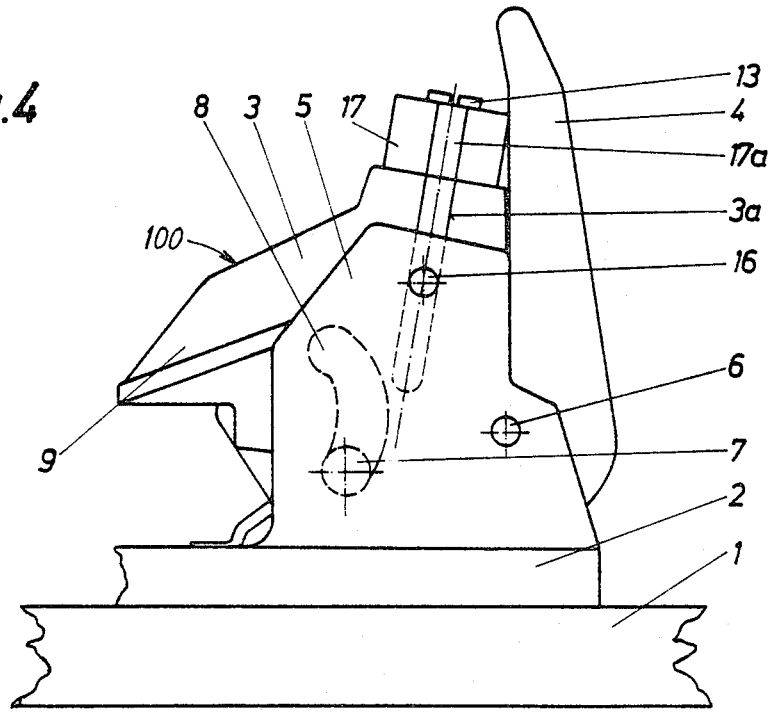
FIG. 4 is a side view of the heel holder also in the cross-country skiing position.

The housing 3 which is preferably manufactured of plastic has a cylindrical upwardly opening spring chamber 12 therein, the axis of which extends approximately vertically when the heel holder is in the closed position. A cylindrical sleeve 17 closed at one end and open at the other end is received in the open end of the spring chamber 12 and is movably guided in the spring chamber by means of two laterally spaced shoulder 17*a* received in appropriately oriented guide grooves 3*a* provided on the interior of the sidewalls of the housing 3 (see FIG. 4). The sleeve 17 is held by means of two pins 16 on the sidewalls of the bearing block 5 and is supported swingably by means of said pins 16 on the bearing block 5. The pins 16 also form the swivel axis of the housing 3. The closed end of the sleeve 17 has an adjusting screw 13 extending therethrough with the head thereof being exteriorly exposed. The shank of the screw 13 has external threads thereon and an abutment 14 theadedly engaged therewith. A spring 11 is provided in the chamber 12 with one end thereof engaging the abutment 14, the other end thereof extending through the open end of the sleeve 17 and being supported on the bottom wall of the spring chamber 12. The initial tension of the spring 11 is adjustable in a conventional manner by means of the adjusting screw 13, which adjusted spring force can be read through a window 15 in the sleeve 17. The window 15 is provided with a scale indicating the relative position of the abutment 14.

A release lever 4 is pivotally mounted on and within the sidewalls of the bearing block 5 of the heel holder 100 for movement about an axle 6 secured to the sidewalls. The release lever 4 is a two-arm lever arm, one arm on each side of the axle 6. The first lever arm 4A projects beyond the extremity of the bearing block 5 and serves as a handle. The second lever arm 4B has adjacent its free end a bolt 18 which extends transversely with respect to the longitudinal axis of the ski and parallel to the axle 6.

Figure 1A:
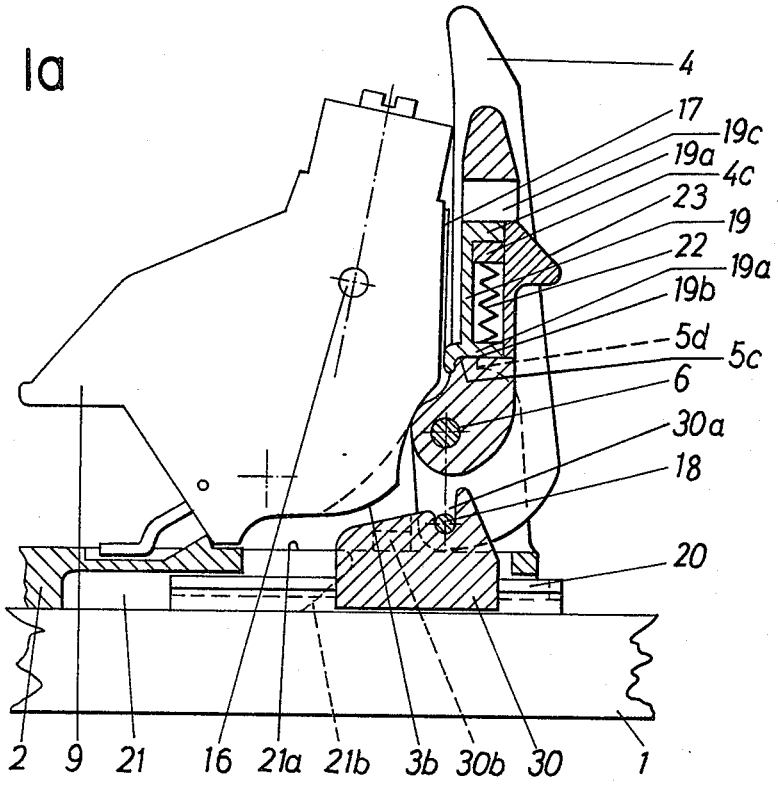
FIG. 1*a* is a side view, partially in cross section of the heelholder in a cross-country skiing position.
Figure 7:
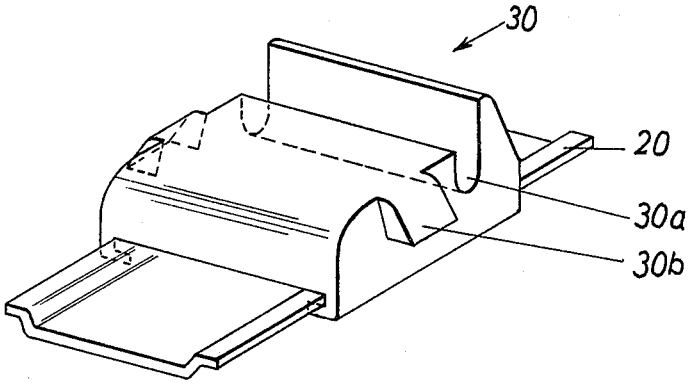
FIGS. 7 to 9 illustrate a locking element of the inventive heelholder, wherein specifically.
Figure 8:
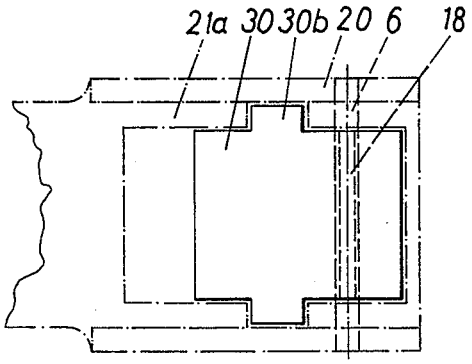
Figure 9:
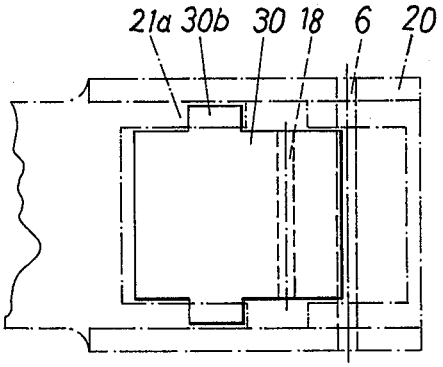

As can be seen from FIGS. 1, and 1*a* in the region under the heel holder 100 there is secured a rail 20 to the ski 1 by means of screws (not illustrated). A slide piece 30 is movably guided on the rail 20 in the direction of the longitudinal axis of the ski 1. In the downhill skiing position of the cross-country ski binding, the rail 20 and the slide piece 30 are housed in a recess or channel 21 in the cross-country plate 2. The slide piece 30 has a part thereon which projects into the swivel range of the bolt 18 on the release lever 4. As can be seen from FIGS. 7 to 9 the aforementioned part has a groove 30*a* therein which opens in an upward direction away from the upper surface of the ski to facilitate the movement of the bolt 18 on the release lever 4 into and out thereof. The slide piece 30 has, in addition, two shoulders 30*b*, which project laterally over the slide piece 30. In the downhill skiing position of the cross-country ski binding, in which position the cross-country ski binding is locked to the ski 1, the shoulders 30*b* grip over support surfaces 21*a* provided on the edge of the recess 21 so that the cross-country plate 2 or the heel holder 100 is secured against a lifting off from the ski 1. Also slide surfaces 21*b* are provided on the two lateral limiting surfaces of the recess 21 and move the slide piece 30 during a setting down of the cross-country plate 2 during cross-country skiing along the rail 20 so that same is guided through the recess 21 of the cross-country plate 2. After cross-country skiing the bolt 18 on the release lever 4 becomes engaged directly in the groove 30*a* of the slide piece 30, when the release lever 4 is thereby fixed for cross-country skiing in the position illustrated in FIG. 1*a*. A swinging of the release lever 4 in clockwise direction effects a movement of the slide piece 30 in a direction toward the tip (left in FIGS. 1 to 6) of the ski, the shoulders 30*b* of the slide piece 30 grip over the support surfaces 21*a* of the recess 21.

Figure 3:
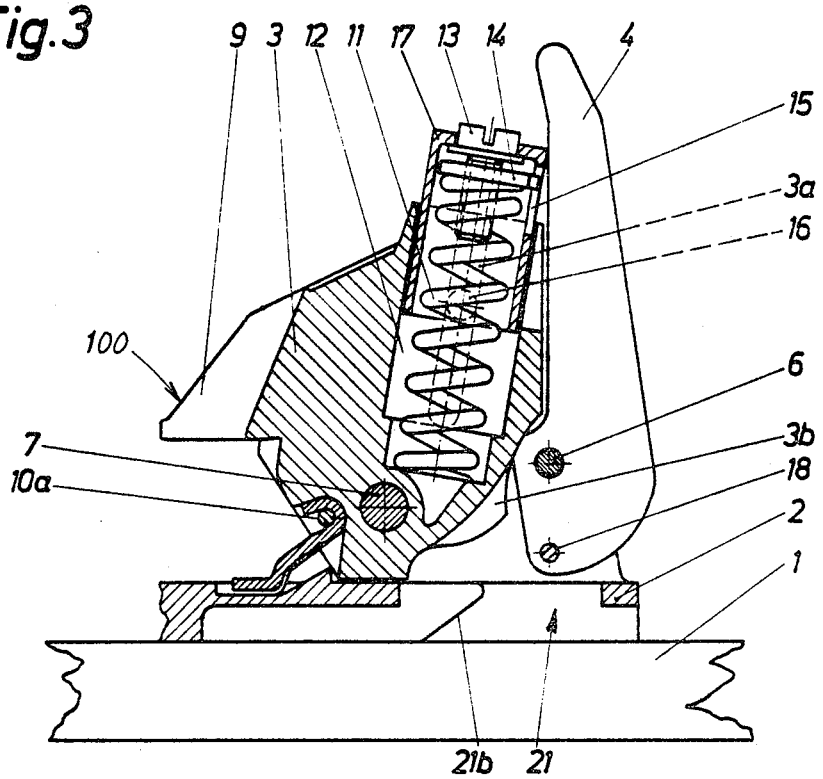
FIG. 3 is a cross-sectional view of the heel holder in a cross-country skiing position.

A slide member 19 is slidably disposed in an elongated channel 19*c* on the release lever 4 by means of two spaced shoulders 19*a* received in the channel. A manually engageable locking lever 23 is fixedly connected to the slide member 19 and projects through a further recess on a region of the release lever 4 not facing the bearing block 5. A spring 22 is arranged within the channel 19*c* between one of the shoulders on the slide member 19 and the locking lever 23 and a cross member 4C on the release lever 4. Locking noses 19*b* are arranged on the slide member 19 and are received in locking recesses 5*c*,5*d* which are provided on the sidewalls of the bearing block 5. The locking recesses 5*d* are provided for fixing the release lever 4 in the downhill skiing position of the heel holder as is illustrated in FIG. 1 and the locking recesses 5*c* are provided for a fixing of the release lever 4 in the cross-country skiing position, as is illustrated in FIGS. 1*a* and 3.

The sidewalls of the bearing block 5 have adjacent the locking recesses 5*c*,5*d*, at the edges facing in a direction toward the tail of the ski, control guideways 5*a*, wherein, viewed in a side view, the distance from the axle 6 of the release lever 4 of successive points on the control guideways 5*a* continuously decreases toward the locking recesses 5*c*,5*d*.

Figure 5:
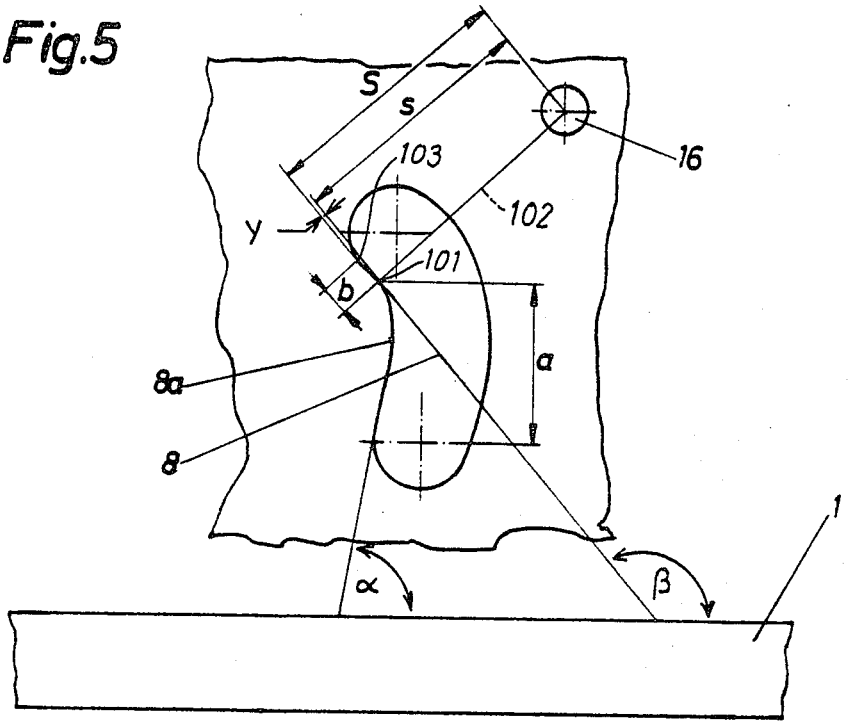
FIG. 5 is an enlarged illustration of an inventive control cam surface.

The control cam surface 8*a* along which the control bolt 7 is controlled during a release is illustrated in an enlarged showing thereof in FIG. 5. The reference point which is important for the release characteristic lies hereby on the axis of the pin 16, which axis forms the pivot axis of the housing 3. In the downhill skiing position of the heel holder, the control bolt 7 is located at the lower region of the control cam surface 8*a* adjacent the upper side of the ski. This part of the control cam surface is formed to the shape of the control bolt 7. Starting out from this lower region, the control cam surface 8*a* is formed into a curved section a, the shape of which is formed to correspond to the desired release characteristic. The direction coefficient which exists at every point along the curve determines the direction of the force (or the force increase) over the covered distance in a force displacement curve. The curved section a terminates at the release point 101 on the control cam surface 8*a*, at which point the tangent to the control cam surface 8*a* defines a right angle with a straight line 102 intersecting this point and the axis of the pin 16. The length of the curved section a corresponds approximately with the size of the vertical elasticity of the heel holder.

The tangent through the starting point of the curved section a defines with the longitudinal axis of the ski, viewed from the side of the ski, an acute angle $\alpha$, the smallest value of which can be approximately 12°, below said value occurs a self-locking, the control bolt 7 can no longer be moved along the control cam surface 8*a*. The angle $\alpha$ is in the present exemplary embodiment approximately 75°. The tangent at the end point 101 of the curved section a defines an angle $\beta$ with the longitudinal axis of the ski, which in the present exemplary embodiment is approximately 140° and should not fall below 90°. This lower value results on the one hand from the form of the curve, on the other hand from the position of the pivot axis 16 relative to the curve. Both factors determine the degree of transfer of the force which acts upwardly onto the sole downholding means onto the spring 11.

Until the release point 101 is reached, the spring 11 is constantly compressed. The curved section a is followed or smoothy connected to a curved section b, the form of which permits the spring 11 to slightly relax. The relaxing distance y of the spring 11 is determined by the difference of two distances S,s. The distance s corresponds with the distance of the release point 101 from the swivel axis 16 along the straight line 102. The distance S corresponds with the distance of a point 103 on the curved section b from the swivel axis 16, which point is the farthest from said axis measured along a line perpendicular to a tangent at the point 103. Upon stepping into the heel holder the release spring 11 is compressed over the distance y. With this the stepping-in force is exactly determined.

During an involuntary release operation, the control bolt 7 is thus forced along the control cam surfaces 8*a*. The sole down-holding means 9 together with the housing 3 is at the same time swung and moved upwardly. Since the sleeve 17 which carries the spring abutment 14 is held on the bearing block 5, the housing 3 slides by means of its guide grooves 3*a* along the shoulders 17*a* of the sleeve 17 upwardly to compress the spring 11. At the same time, and as stated above, a swinging movement of the housing 3 occurs around the axis of the pin 16 which holds the sleeve 17 on the bearing block 5. If the control bolt 7 has exceeded the release point 101 on the control cam surface 8*a*, the heel holder swings automatically into its open position and a ski shoe which was heretofore inserted into the binding is released. The release lever 4 remains during a voluntary release operation in its original position. During a stepping into the binding, the sole down-holding means 9 is moved into the downhill skiing position by overcoming the stepping-in force which is determined by the distance y.

Figure 2:
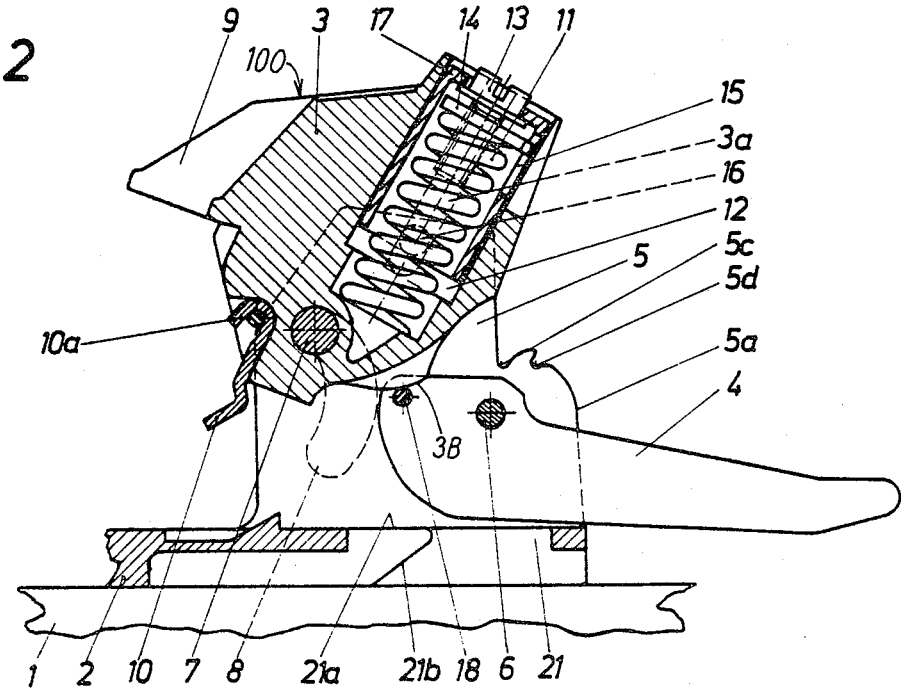
FIG. 2 is also a cross-sectional view of the heel holder in a position following a voluntary opening thereof.

During a voluntary opening of the heel holder, the release lever 4 is swung in a clockwise direction to the position shown in FIG. 2. The locking noses 19*b* of the slide member 19 slide along the control guideways 5*a* of the bearing block 5 while compressing the spring 22. The bolt 18 of the release lever 4 engages a cam surface 3*b* on the underside of the housing 3 and forces the housing 3 to move along a path defined by the control cam surface 8*a* into the open position. After letting go of or freeing the manual engagement with the release lever 4, the release lever 4 is returned by the spring 22 and the locking nose 19*b* slide along the control guideways 5*a* of the bearing block toward its initial position.

Figure 6:
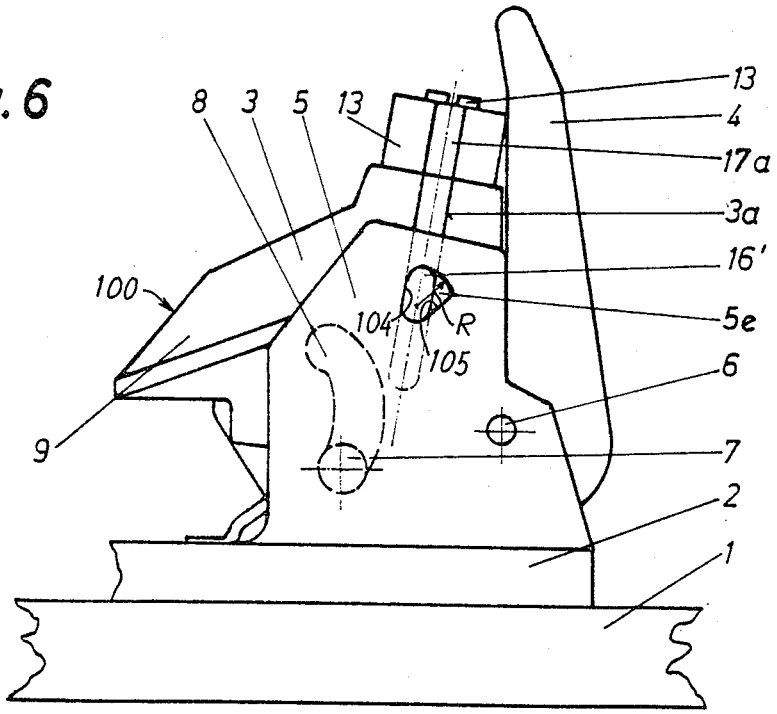
FIG. 6 illustrates a further exemplary embodiment of an inventive heel holder.

If the distance between the pivot axis 16 of the housing 3 from the control bolt 7 is reduced, then during an opening of the heel holder the angle of traverse of the down-holding means 9 is increased. FIG. 6 illustrates a modified embodiment of such an arrangement of the pivot axis 16', wherein a compact design of the heel holder is of primary importance. One axle piece 16' is arranged on each side of the sleeve 17, which axle piece, viewed in a side view, has an elongated shape corresponding to the counterpart of a slotted hole. The pivot axis of the housing 3 is formed by the two lower regions of the axle piece 16'. The upper regions of the axle piece 16' correspond with the position of the pins 16 of the first exemplary embodiment. The two laterally spaced axle pieces 16' are arranged in axially aligned recesses 5*e* in the sidewalls of the bearing block 5. Each recess 5*e* is substantially triangularly shaped, wherein the three corner areas of the recess 5*e* are rounded at the same radius as the upper and lower end regions of the axle piece 16'. The upper edge of the recess 5*e* is rounded at a radius R from the lower region of the axle piece 16'. In the closed position (downhill skiing position) of the heel holder, the axle pieces 16' rest on the edges 104 of the recesses 5*e*, which edges are adjacent the down-holding means 9. During an opening of the heel holder, be it voluntarily or automatically involuntarily, the axle pieces 16' swing, as soon as the control bolt 7 has exceeded the release points of the control cam surfaces 8*a*, around the axis of its lower region until they rest on the edges 105 of the recess 5*e* remote from the down-holding means 9.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a heel holder for a safety ski binding, in particular for a safety ski binding for both cross-country skiing and downhill skiing, said heel holder having a bearing block fixed relative to the ski and a housing which carries a sole holder thereon, said housing being supported for pivotal movement upwardly at the ski boot engaging part thereof about an axis provided on the bearing block and extending transversely with respect to the longitudinal axis of the ski and against the force of a spring arranged in a spring chamber which is constructed in said housing, one end of said spring being supported on a housing-fixed part and the other end being supported on an adjustable abutment which is held on the bearing block, a two-arm release lever which is hingedly connected to the bearing block, wherein a control bolt which is held on the housing is guided along at least one control cam surface arranged on two sidewalls of the bearing block, the improvement comprising wherein each control cam surface is constructed on the inner side of the sidewall of the bearing block, wherein the pivot axis of the housing is arranged at the upper region of the bearing block, and wherein said pivot axis is offset rearwardly relative to the control bolt.

2. The heel holder according to claim 1, wherein each control cam surface is defined by the edge of at least one arcuately shaped recess on the sidewalls of the bearing block, wherein said control cam surface has a first curved section (a), the tangent of which defines adjacent the starting point of the curved section (a) an acute angle ($\alpha$) with the longitudinal axis of the ski, viewed from the tail of the ski, which angle is greater than 12°, preferably approximately 75°, and the tangent of which defines adjacent the termination point of the curved section (a) an angle ($\beta$) with the longitudinal axis of the ski, which angle is greater than 90°, preferably approximately 140°, and wherein the length of the curved section (a) determines the elasticity range of the heel holder.

3. The heel holder according to claim 2, wherein a further curved section (b) is connected to the first curved section (a), which further curved section (b) assures a slight relaxation of the spring, wherein the relaxing distance (y) of the spring is determined by the difference of two distances, wherein a first distance (S) is the distance of the point of the curved section (b) farthest from the swivel axis and a second distance (s) is the distance of the termination point of the first curved section (a) from the pivot axis.

4. The heel holder according to claim 1, wherein the adjustable abutment of the spring is held in a sleeve which is open at one end thereof, which sleeve is held on the bearing block by pins which form the pivot axis of the housing and has two shoulders received in guide grooves provided on the housing, which shoulders and guide grooves extend parallel with respect to the longitudinal extent of the sleeve.

5. The heel holder according to claim 1 for a safety ski binding, which has a cross-country plate carrying the bearing block thereon and which can be swung upwardly about an axis which extends transversely with respect to the longitudinal axis of the ski, wherein the housing carries at least one cam, which is engaged by a bolt arranged on the release lever and which extends transversely with respect to the longitudinal axis of the ski, said bolt defining a locking element which is provided for locking and unlocking the cross-country plate on the ski.

6. The heel holder according to claim 1 or 5, wherein a slide member is arranged on the release lever, which slide member carries a locking lever, by means of which locking noses on the slide member can against the force of a spring engage and disengage from locking recesses provided on the sidewalls of the bearing block, wherein locking recesses are provided for fixing the release lever in its position for the cross-country skiing and locking recesses are provided for a fixing of the release lever in the downhill skiing position.

7. The heel holder according to claim 6, wherein the spring on said release lever is arranged in a cavity which is constructed between the locking lever and the slide member and has one end thereof supported on the slide member and its other end on a web of the release lever.

8. The heel holder according to claim 6, wherein on the bearing block in a direction toward the tail of the ski there is provided a control guideway merging into the locking recesses, wherein, viewed in a side view, the distance between successive points of the control guideway and the pivot axis of the release lever increases continuously, which locking noses can be moved along the control guideways during a swinging of the release lever in clockwise direction against the force of the spring on the release lever.

9. The heel holder according to claim 4, wherein for enlarging the opening angle of the down-holding means the pivot axis is formed by the lower regions of two axle pieces defining said pins which are provided on said sleeve, which axle pieces are designed as countermating pieces of slotted holes and are arranged in at least one substantially triangular recess in the sidewalls of the bearing block, wherein the axle pieces in the closed position of the heel holder rest on edges of the recesses facing the down-holding means and after opening of the heel holder rest on the edges of the recesses which do not face the down-holding means.

* * * * *